US008438897B2

(12) United States Patent
Aichele et al.

(10) Patent No.: US 8,438,897 B2
(45) Date of Patent: May 14, 2013

(54) FORMING DEVICE

(75) Inventors: Helmut Aichele, Goppingen (DE); Thomas Pfluger, Sussen (DE)

(73) Assignee: Hinterkopf GmbH, Eislingen/Fils (DE)

( * ) Notice: Subject to any disclaimer, the term of this patent is extended or adjusted under 35 U.S.C. 154(b) by 271 days.

(21) Appl. No.: 13/044,121

(22) Filed: Mar. 9, 2011

(65) Prior Publication Data

US 2011/0219838 A1 Sep. 15, 2011

(30) Foreign Application Priority Data

Mar. 10, 2010 (EP) ..... 10002467

(51) Int. Cl.
*B21J 11/00* (2006.01)

(52) U.S. Cl.
USPC ..... 72/405.03; 72/422; 72/94; 413/69; 413/70

(58) Field of Classification Search ..... 72/94, 405.03, 72/405.09, 419–423, 379.4, 715; 413/66–77; 29/557, 38 A, 38 F, 38 C, 38 R, 48.5 R, 49, 29/48.5 A, 37 R, 33 J; 294/99.1; 198/473.1, 198/480.1, 481.1
See application file for complete search history.

(56) References Cited

U.S. PATENT DOCUMENTS 3,797,429 A 3/1974 Wolfe
5,282,375 A * 2/1994 Lee et al. ..... 72/4
7,263,915 B2 * 9/2007 Lu ..... 74/813 R
2007/0271871 A1 * 11/2007 Spence et al. ..... 53/201
2008/0069665 A1 3/2008 Hanafusa et al.

FOREIGN PATENT DOCUMENTS

EP 0275369 7/1988
WO WO0158618 8/2001
WO WO2008077231 7/2008

* cited by examiner

*Primary Examiner* — Edward Tolan
*Assistant Examiner* — Matthew G Katcoff
(74) *Attorney, Agent, or Firm* — Hoffmann & Baron, LLP

(57) ABSTRACT

A forming device for cup-shaped hollow bodies, including a machine frame, a drive device, a workpiece turntable and a tool holder, wherein the drive device (15) is designed to provide a rotational step movement and a cyclic linear movement between the workpiece turntable and the tool holder, and wherein the workpiece turntable is assigned at a locking position a first actuating means for triggering a locking movement on the respective workpiece holder and at an unlocking position a second actuating means for triggering an unlocking movement on the respective workpiece holder. A third actuating means is arranged along a curved machining path for the hollow bodies between the locking position and the unlocking position so as to trigger a combined unlocking and locking movement on the respectively associated workpiece holder in order to at least partially unlock, optionally move and then lock once again the hollow body held in the respective workpiece holder during one cycle of the cyclic linear movement of the tool holder.

20 Claims, 6 Drawing Sheets

FORMING DEVICE

BACKGROUND OF THE INVENTION

The invention relates to a forming device for cup-shaped hollow bodies, comprising a machine frame, a drive device, a workpiece turntable for holding workpiece holders which are designed to fix hollow bodies, and a tool holder for holding machining tools, wherein the workpiece turntable and the tool holder are located opposite one another and can rotate relative to one another about an axis of rotation and can move linearly relative to one another along the axis of rotation, wherein the drive device is designed to provide a rotational step movement and a cyclic linear movement between the workpiece turntable and the tool holder in order to allow a forming of the hollow bodies by means of the machining tools in a plurality of successive machining steps, and wherein the workpiece turntable is assigned at a locking position a first actuating means for triggering a locking movement on the respective workpiece holder and at an unlocking position a second actuating means for triggering an unlocking movement on the respective workpiece holder. The invention also relates to a method for operating a forming device.

EP 0 275 369 A2 discloses a forming machine with which cup-shaped hollow bodies made from metal, in particular aluminium, can in some regions be shaped, in particular locally drawn inwards, from a substantially cylindrical sleeve-shaped initial state in order for example to be able to install a closure cap or a spray valve in a leaktight manner in the region of the opening. The known forming machine comprises a machine frame on which a support tube is formed. A workpiece turntable is rotatably mounted on an outer surface of the support tube. A linearly displaceable guide tube is received in a recess delimited by the support tube, the tool turntable being mounted at the end region of said guide tube. Accommodated in the machine frame is a drive device which is designed to produce an intermittent rotational movement of the workpiece turntable and to produce an oscillating linear movement of the guide tube and of the tool turntable connected thereto. By virtue of the linear movement, the tools provided on the tool turntable, in particular forming tools, can be brought into engagement with the hollow bodies held on the workpiece turntable in order to locally machine, in particular plastically deform, said hollow bodies. By virtue of the intermittent rotational movement of the workpiece turntable, the hollow bodies can be brought in series into contact with the tools attached to the tool holder table, in order to achieve a step-by-step forming of the hollow bodies from an initial geometry to a target geometry. Before carrying out the machining, the hollow bodies are fixed by workpiece holders attached to the workpiece turntable and are released again once the machining has been carried out.

SUMMARY OF THE INVENTION

The object of the invention is to provide a forming device which allows additional design freedom in the machining of the hollow bodies.

For a forming device of the type mentioned in the introduction, it is provided here that a third actuating means is arranged along a curved machining path for the hollow bodies between the locking position and the unlocking position, said third actuating means being designed to trigger a combined unlocking and locking movement on the respectively associated workpiece holder in order to at least partially unlock, optionally move and then lock once again the hollow body held in the respective workpiece holder during one cycle of the cyclic linear movement of the tool holder.

By virtue of the at least partial unlocking of the hollow body, it is possible for example to reposition the hollow body relative to the workpiece holder. This may be necessary for example after a previous significant forming of the hollow body, during which a relative movement of the hollow body relative to the workpiece holder may have taken place and/or through which the hollow body has been deformed in such a way that it no longer bears against corresponding bearing surfaces in the workpiece holder, as may be the case for example when forming the concave base region of the hollow body. In order to correct the resulting possible misalignment and/or imprecise bearing of the hollow body relative to the workpiece holder and to achieve a precise alignment of the hollow body relative to the workpiece holder, the holding forces exerted on the hollow body by the workpiece holder are reduced. As a result, the hollow body can be realigned relative to the workpiece holder without any risk of undesired deformation, particularly in the clamping region of the workpiece holder, and thus a highly precise further machining of the hollow body during subsequent machining steps is made possible. Preferably, the at least partial unlocking and relocking of the hollow body takes place during the cycle, particularly preferably during a fraction of the cycle, of the cyclic linear movement of the tool holder. It is thus possible for example to achieve the situation whereby the hollow body is fully locked in the workpiece holder during the rotational step movement which is necessary in order to reach the working position of the workpiece holder attached to the workpiece turntable relative to the third actuating means and which is preferably synchronised with the cyclic linear movement. Moreover, it can thus also be ensured that the hollow body is likewise fully locked in the workpiece holder during the subsequent rotational step movement to leave the corresponding working position of the workpiece turntable, and is thus not additionally and/or repeatedly moved relative to the workpiece holder due to the accelerations that occur. The cyclic linear movement and the rotational step movement are preferably tailored to one another in such a way that the rotational step movement of the workpiece turntable takes place when the machining tools arranged on the tool holder are not in engagement with the hollow bodies. With particular preference, the cyclic linear movement and the rotational step movement are carried out at the same frequency, which may for example lie in a range between 50 Hertz (1/s) and 300 Hertz (1/s).

It is advantageous if the third actuating means is designed to provide a linear movement which is preferably oriented transversely to the axis of rotation. The unlocking and locking of the workpiece holder and of the hollow body held therein can be performed with the aid of this actuating movement. The actuating movement may take place as a purely linear movement or as a superposition of a linear movement with a pivoting movement. A purely linear movement is provided for example by a linear direct drive, in particular one which can be operated electrically, or by a fluidically operated working cylinder. A superposed movement which combines a rotational movement with a linear movement may be brought about for example by a pivoting of a control cam or link relative to the workpiece holder. Alternatively, a purely rotational movement may also be triggered, for example via a gear train, as an actuating movement on the workpiece holder in order to lock and/or unlock the latter.

In one further development of the invention, it is provided that the third actuating means is designed to provide a cyclically repeating actuating movement on the respectively associated workpiece holder, said actuating movement in particular being synchronised with the cyclic linear movement and/or with the rotational step movement. It is thus ensured that the workpiece holder respectively assigned to the third actuating means and positioned opposite the latter is suitably acted upon by the actuating movement. Preferably, the cyclic actuating movement of the third actuating means is synchronised with the cyclic linear movement and/or with the rotational step movement so that there is a fixed phase relationship between the movements. With particular preference, the cyclic actuating movement and the cyclic linear movement and/or the rotational step movement are synchronised with one another in such a way that an unlocking and locking of the workpiece holder takes place within one cycle portion of the cyclic linear movement, preferably during a movement pause between two rotational step movements. In this case, it may be provided that the actuating movement of the third actuating means for the at least partial unlocking of the workpiece holder is effected as the machining tool approaches the hollow body, which takes place during a first cycle portion of the cyclic linear movement. A locking of the workpiece holder may take place during a second cycle portion of the cyclic linear movement, for example as soon as the machining tool has once again moved away from the hollow body. Preferably, the rotational step movement is tailored to the cyclic linear movement in such a way that a rotation of the workpiece turntable takes place during a third cycle portion of the cyclic linear movement, in which there is no actuating movement of the third actuating means and thus the hollow body is securely held in the workpiece holder.

Preferably, the actuating means are designed to actuate a clamping device which is arranged in the workpiece holder and which can preferably be actuated by a pivotably mounted operating lever assigned to the workpiece holder. The clamping device may be designed for example as a mechanically or fluidically operated collet chuck in which, as the actuating movement is being carried out, an actuating force is triggered which leads to an opening movement or to a closing movement of the collet chuck. The collet chuck grips the hollow body preferably in an annular contact region and exerts a holding force on the hollow body, said holding force preferably being uniform around the circumferential region. It is advantageous if the holding force is oriented radially inwards relative to a longitudinal axis of the hollow body, since additional friction forces between the clamping device and the hollow body can be brought about as a result and prevent a movement of the hollow body in the direction of the longitudinal axis and/or a tilting of the hollow body about axes transverse to the longitudinal axis.

In a further embodiment of the invention, the clamping device is assigned biasing means which are designed to set the clamping device into a preferred position intended in particular for immobilising the hollow body, wherein the biasing means are configured in such a way that they can be overridden by the actuating means in order to allow the actuation of an operating position other than the preferred position. The biasing means, which may be designed for example as spring means, in particular as helical springs or plate springs, have the task of bringing the clamping device into a defined preferred position, for example a fully open or fully closed position, when no actuating movement is being triggered on the workpiece holder. Preferably, the biasing means are configured in such a way that the workpiece holder, without any external influences, is in a closed position in which the hollow body is reliably locked to the workpiece holder. As a result, during the rotational step movement of the workpiece turntable, a large number of machining operations, in particular forming processes and material-removing processes, can be carried out on the hollow body without any influencing of the workpiece holder being necessary for this. Instead, the hollow body is fixed in the workpiece holder on account of the biasing means. The biasing means are designed in such a way that they provide a minimum energy that is required for the reliable immobilising of the hollow body on the workpiece holder. It must also be ensured that the actuating means are able to introduce into the respective workpiece holder an amount of energy that is sufficient to override the biasing means in order to allow a partial or full unlocking of the clamping device and thus of the hollow body.

It is advantageous if the third actuating means comprises a cam disc which is mounted such as to be able to rotate about an axis of rotation and which is designed to provide the actuating movement for the respectively associated workpiece holder. By means of a cam disc, it is possible to ensure a reliable actuating movement of the third actuating means which can be adapted to short cycle times. The cam disc may have on an outer circumferential surface and/or on an inner circumferential surface one or more control surfaces which can serve for transmitting force to the workpiece holder. Preferably, the cam disc has outer and/or inner circumferential surfaces which are formed at least partially eccentrically to the axis of rotation and which, during a rotation of the cam disc about the axis of rotation, lead to a linear actuating movement relative to the workpiece holder in order to actuate the clamping device there.

It is provided in one further development of the invention that the actuating means is assigned a drive means which is designed to provide the actuating movement. The drive means may be the drive device which is also intended to provide the cyclic linear movement and the rotational step movement and which is preferably coupled, in particular positively coupled, to the actuating means via a gear device. The drive means is preferably designed as a stand-alone primary drive which is designed to convert electrical or fluidic energy into a rotational movement. With particular preference, the drive means is designed as an electric servo drive which is supplied with electrical energy by a control device. Preferably, the drive means is electronically synchronised with the cyclic linear movement and/or the rotational step movement.

Preferably, a plurality of actuating means are kinematically connected to one another by the drive means for synchronised, in particular in-phase, actuating movements. This ensures a simple design for the actuating means since the synchronisation of the actuating means can be achieved in a simple manner by the kinematic coupling, which may be in particular a positive coupling of the actuating means to the drive means. With particular preference, a plurality of actuating means are coupled to one another in such a way that the actuating movements provided thereby take place in phase with one another. As a result, advantageous use can be made of the time window available for the at least partial unlocking and the subsequent locking, in particular between two rotational step movements and/or during the cyclic linear movement.

It is advantageous if a plurality of actuating means are coupled to one another by an endlessly revolving traction means which can be driven by the drive means. The traction means may be designed for example as a chain or as a toothed chain or as a toothed belt and, given a suitable configuration of the driven wheels assigned to the respective actuating means, for example sprockets or toothed wheels, allows a slip-free transmission to the actuating means of the movement provided by the drive means. By using an endless traction means, a compact arrangement of the actuating means is possible. Additional actuating means can moreover be added if necessary, or existing actuating means can be temporarily shut down, without this resulting in a considerable effort in terms of assembly and/or adjustment for the other actuating means.

The invention also relates to a method for operating a forming device. The method is carried out on a forming device which comprises a machine frame, a drive device, a workpiece turntable to which a plurality of workpiece holders can be attached for holding hollow bodies and which is assigned at a locking position a first actuating means for triggering a locking movement on the respective workpiece holder and at an unlocking position a second actuating means for triggering an unlocking movement on the respective workpiece holder, and a tool holder for holding machining tools, wherein the workpiece turntable and the tool holder are located opposite one another and can rotate relative to one another about an axis of rotation and can move linearly relative to one another along the axis of rotation, and wherein the drive device is designed to provide a rotational step movement and a cyclic linear movement between the workpiece turntable and the tool holder in order to allow a forming of the hollow bodies by means of the machining tools in a plurality of successive machining steps.

The method comprises the following steps:

Feeding a hollow body into a workpiece holder, for example at a loading position of the workpiece turntable and preferably by means of a loading starwheel which picks up the hollow body from a conveyor belt and places it directly in front of a receiving opening of the respective workpiece holder in order then to push the hollow body into the workpiece holder by means of a linearly movable loading mandrel.

Thereafter, an actuation of the first actuating means takes place in order to trigger a locking movement on the respective workpiece holder, which is located at a locking position. The locking position may be identical to the loading position or may be arranged one or more rotational step movements away from the loading position. By way of example, it may be provided to carry out a base forming process directly at the loading position, during which an originally flat base region of the hollow body is provided with a depression which is curved in the direction of the cavity enclosed by the hollow body and is concave when seen from outside. Alternatively, the base forming process may be carried out at a position which is one or more rotational step movements away from the loading position. In this case, the hollow body may not be locked in the workpiece holder for example until after the base forming process. During the rotational step movements between the loading position and the locking position, the hollow body is in this case held only loosely in the workpiece holder.

In a further method step, a machining process and/or a detection process is carried out on the hollow body. The machining process may be for example a forming process or a material-removing process, for example a milling of the end face of the hollow body. During the detection process, a rotational position of the hollow body in terms of its longitudinal axis relative to the workpiece holder may be determined for example, which is critical for a further, possibly rotationally non-symmetrical, machining of the wall of the hollow body. This plays a role in particular when the hollow body is provided with a rotationally non-symmetrical decoration, in particular a print, and a precise match is to be achieved between the decoration and the local deformations to be produced on the hollow body.

Thereafter, a third actuating means is actuated in order to trigger a combined unlocking and locking movement on the workpiece holder and thereby to at least partially unlock, optionally move and then lock once again the hollow body held in the respective workpiece holder. The temporary, at least partial unlocking of the hollow body held in the workpiece holder may be used for example to align the hollow body exactly in relation to a reference surface formed preferably on the workpiece holder, and thus to ensure precise further machining. In addition or as an alternative, the hollow body may be rotated about its longitudinal axis during the at least partial unlocking in order to position it precisely, in terms of its rotational orientation, for a subsequent machining step which is preferably to be carried out only on sub-regions of its sleeve-shaped lateral face. The hollow body is then locked once again in the workpiece holder by means of the third actuating means and/or integrated biasing means in order to be able to maintain the defined positioning in the workpiece holder also during the subsequent rotational step movement and machining.

In a further machining step, a further machining process and/or a further detection process is carried out on the hollow body. By way of example, due to the realignment of the hollow body relative to the workpiece holder that has taken place in the previous machining step, a precise local and in particular rotationally non-symmetrical machining of the hollow body can now take place, preferably in a manner congruent with a decoration applied to the hollow body.

In a final machining step, the second actuating means is actuated in order to trigger an unlocking movement on the respective workpiece holder. This takes place at an unlocking position at which there is arranged for example an unloading starwheel which is located opposite the respective workpiece holder conveyed to the unlocking position by the workpiece turntable and to which preferably a vacuum is applied, said unloading starwheel being provided for picking up the hollow body and further transporting the hollow body, for example on a conveyor belt. Following the triggering of the unlocking movement on the workpiece holder and the resulting release of the hollow body, the hollow body can be transferred from the workpiece holder to the unloading starwheel in a linear movement by means of an ejector.

In one further development of the method, it is provided that the third actuating means carries out an at least partial unlocking and subsequent locking of the workpiece holder during one cycle of the cyclic linear movement. This ensures that the hollow body is securely locked in the workpiece holder at the start of the cycle of the linear movement, at which usually the rotational step movement takes place. In the further course of the cycle of the linear movement, preferably in a time interval in which the workpiece turntable is at a standstill and no rotational step movement takes place, the hollow body can be unlocked and manipulated in a predefinable manner, for example rotated about its longitudinal axis and/or aligned on the workpiece holder. Towards the end of the cycle of the linear movement, the hollow body is once again securely locked in the workpiece holder in order not to tilt it in the workpiece holder or cause it to slide out of the workpiece holder as a result of the accelerations occurring at this time during the rotational step movement which starts at this point in time.

It is advantageous if the at least partial unlocking and subsequent locking of the workpiece holder is used for a rotation of the hollow body about a longitudinal axis of the hollow body, said longitudinal axis preferably being oriented parallel to the cyclic linear movement, and/or for a pressing of the hollow body against a bearing surface in the workpiece holder. As a result, the hollow body can be oriented in such a way that a desired match between a decoration applied to the hollow body and the machining tool(s) intended for the local machining of the lateral wall of the hollow body is ensured in one or more subsequent machining steps.

Preferably, the at least partial unlocking and subsequent locking of the workpiece holder takes place in order to be able to carry out a linear movement of the hollow body along a longitudinal axis of the hollow body, said longitudinal axis preferably being oriented parallel to the cyclic linear movement. As a result, once the machining processes have been carried out, through which the hollow body may possibly have been at least partially pulled or pushed out of the workpiece holder, it is possible to achieve a pressing of the hollow body against a bearing surface which is provided in the workpiece holder and which serves as a depth stop for the hollow body.

In one further development of the invention, an at least partial unlocking and subsequent locking of the workpiece holder is carried out during the cyclic linear movement at a plurality of working positions of the rotational step movement between the locking position and the unlocking position. Due to the temporary unlocking and subsequent locking of the hollow body which takes place at a plurality of working positions of the workpiece turntable, said hollow body can be ideally positioned relative to the workpiece holder and thus also relative to the engaging machining tools for the subsequent machining processes in each case.

BRIEF DESCRIPTION OF THE DRAWINGS

One advantageous embodiment of the invention is shown in the drawing, in which.

DETAILED DESCRIPTION OF THE PREFERRED EMBODIMENTS

Figure 1:
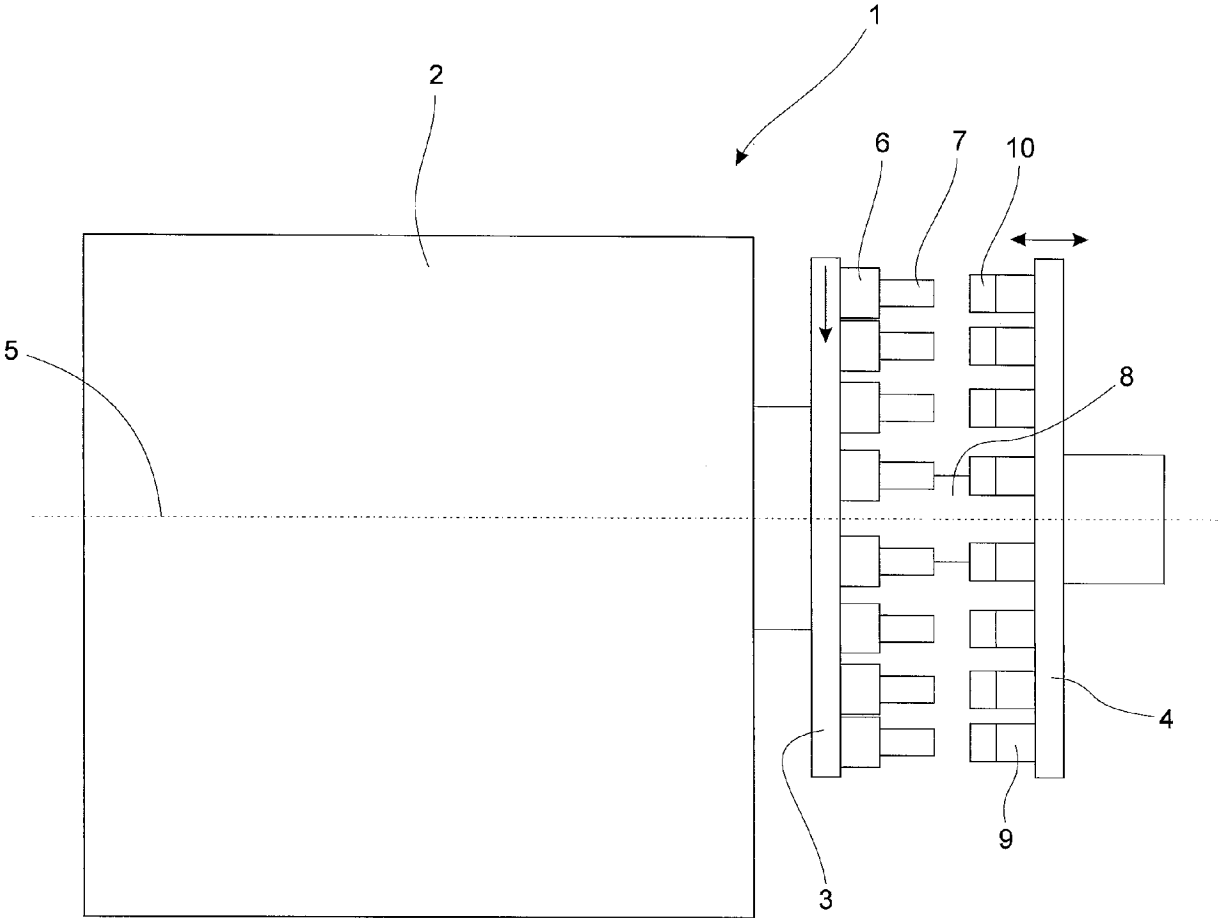
FIG. 1 shows a schematic side view of a forming device.

A forming device 1 shown in FIG. 1 is designed for machining hollow bodies, in particular aluminium cans, in a step-by-step forming process. The forming device 1 comprises a machine frame 2, on which for example a workpiece turntable 3 is mounted in a rotatable manner and a tool holder 4 is mounted in a linearly movable manner, as indicated by the corresponding arrows in FIG. 1.

By means of a drive device (not shown in any detail in FIG. 1), the workpiece turntable 3 is movable about an axis of rotation 5 in a step-by-step rotational movement which is also referred to as a rotational step movement. Preferably, the drive device and the workpiece turntable 3 are tailored to one another in such a way that the rotational step movement always takes place with the same step width, in particular with the same angle around the axis of rotation 5. Arranged on the workpiece turntable 3, preferably at an equal angular spacing around the axis of rotation 5, are a plurality of workpiece holders 6 which are designed to hold hollow bodies 7.

The drive device which is accommodated in the machine frame 2 and which is not shown in FIG. 1 is moreover designed to provide a cyclic linear movement on the tool holder 4. The tool holder 4 is mounted in a linearly movable manner on a support tube 8 and can carry out an oscillating stroke movement relative to the workpiece turntable 3. Arranged on the tool holder 4 are a plurality of tool holders 9 which are arranged at the same angular spacing around the axis of rotation 5 as the workpiece holders 6 on the workpiece turntable 3 and are provided for holding machining tools 10, in particular forming tools or material-removing tools such as milling cutters. By means of the machining tools 10, forming operations or other machining operations can be carried out on the hollow bodies held in the workpiece holders 6 during the cyclic linear movement of the tool holder.

In each working position of the workpiece turntable 3 obtained after a rotational step movement has taken place, the workpiece holders 6 are arranged opposite the tool holders 9 and can carry out the desired machining of the hollow bodies during the cyclic linear movement.

Figure 2:
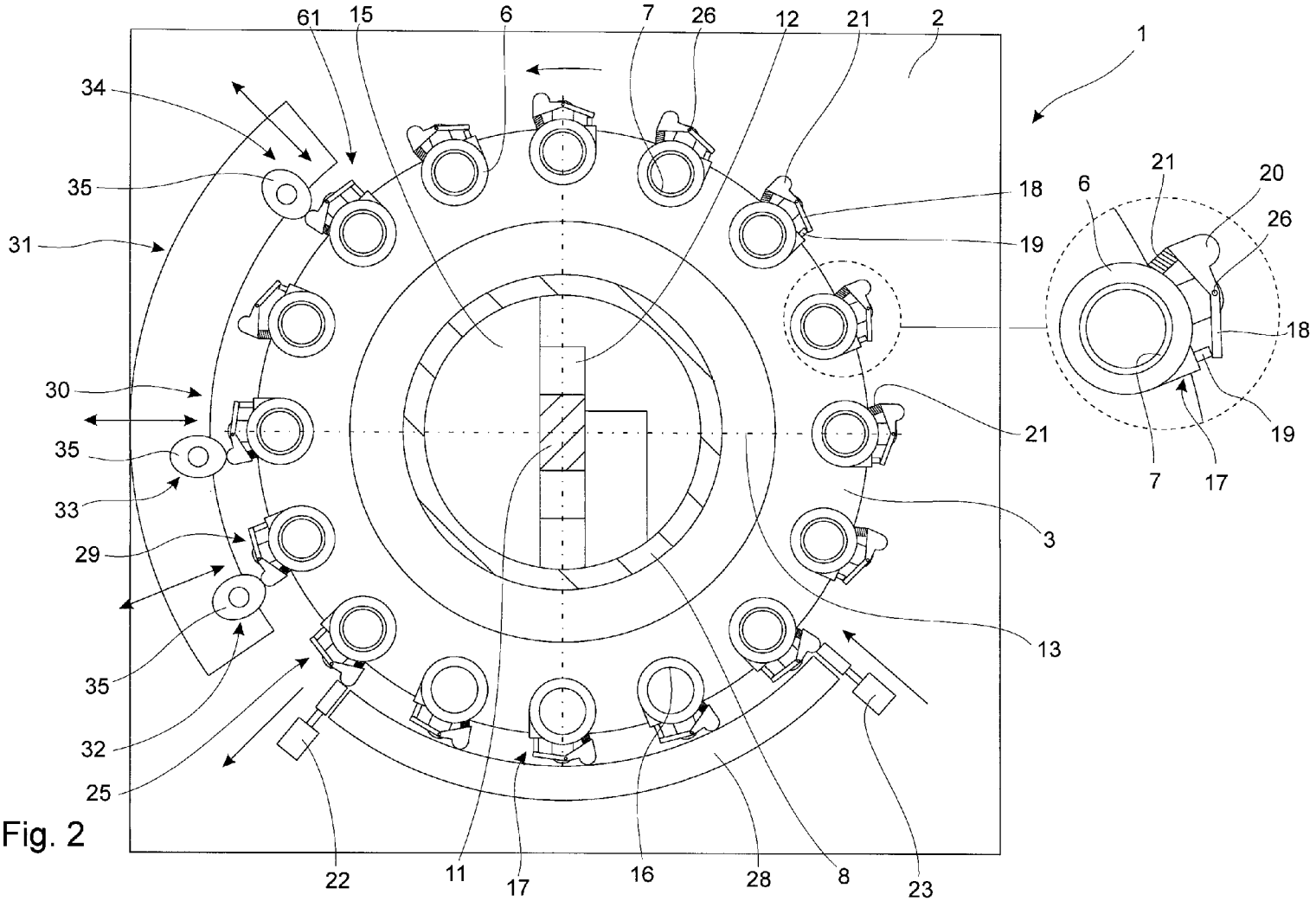
FIG. 2 shows a partially cut-away front view of the forming device shown in FIG. 1.

In the schematic diagram in FIG. 2, it is possible to see the arrangement of the workpiece holders 6 at a constant angular spacing around the axis of rotation 5, the latter running perpendicular to the plane of the drawing. The direction of the rotational step movement for the workpiece turntable is shown by way of example in the anticlockwise direction. In a time interval between two rotational step movements, each of the workpiece holders 6 assumes a fixed working position in which an interaction takes place with the machining tools 10 (not shown) which are held on the tool holder 4 (not visible).

In FIG. 2, the support tube 8 on which the tool holder is guided in a linearly movable manner can be seen in cross-section. Guided in the support tube 8 is a coupling slide (not shown in any detail) which can be displaced linearly along a movement axis oriented perpendicular to the plane of the drawing in FIG. 2. The coupling slide is coupled to a connecting rod 11. The connecting rod 11 is coupled to a double eccentric arrangement 12 which can be rotated by a drive device 15 about an axis of rotation 13 in order to generate, from a purely rotational movement, a combined rotational and translational movement which is transmitted to the connecting rod 11. The connecting rod 11 moves the coupling slide in a cyclic linear movement which is transmitted to the tool holder 4.

Each of the workpiece holders 6 comprises an integrated clamping device 17 which is designed to constrict at least partially in the radial direction a recess 16 (for example cylindrical in shape) in the workpiece holder 6 and thus to apply the clamping force necessary for clamping the hollow body 7.

For actuating the clamping device 17, each of the workpiece holders 6 is assigned by way of example an operating lever 18 which is pivotably mounted on the workpiece holder 6 by means of a pivot bearing 26 and is provided for actuating a control pin 19 that is provided by way of example. The control pin 19 is associated with the clamping device 17 and can act for example on a fluid piston (not shown) of the clamping device 17, which is provided for example for pressurising a fluid, in particular a hydraulic fluid, that is contained in the clamping device 17. By way of example, it may be provided that the clamping device 17 comprises an annular elastic membrane arranged circumferentially in the recess 16. This membrane may be configured in such a way that it bulges radially inwards when the fluid in the clamping device 17 is pressurised, and thus brings about the desired constriction of the cross-section of the recess 16 in order to clamp the hollow body 7.

The operating lever 18 has, for example on a face pointing away from the workpiece holder 6, a cam extension 20 which is provided to bear against control elements that will be described in greater detail below. A spring device 21 is arranged between the workpiece holder 6 and an end region of the operating lever 18 remote from the control pin, which spring device may be designed for example as a pressure spring, in particular as a helical spring or plate spring stack. The spring device 21 exerts for example a pressure force on the associated end region of the operating lever 18. By way of example, the pressure force is such that the clamping device 17 is brought into a closed preferred position without external influences. This ensures that, with no external influence on the workpiece holder 6, in particular on the operating lever 18, the clamping device 17 reliably fixes the hollow body 7 in the workpiece holder 6.

In order to unlock the hollow body 7 from the workpiece holder 6, by way of example an actuating movement which is directed at least almost radially inwards is triggered on the operating lever 18. In a first embodiment of an actuating means, this actuating movement can be triggered as a purely linear movement on the operating lever 18. To this end, use may be made for example of a fluidically or electrically operated linear actuator, in particular a fluid cylinder or an electric linear direct drive. By way of example, in the embodiment of FIG. 2, the first actuating means 22 and the second actuating means 23 are each designed as linear actuators. A control rail 28 is arranged between the second actuating means 23, which are assigned to an unloading position 24 of the workpiece turntable 3, and the first actuating means 22, which are assigned to a loading position 25 of the workpiece turntable 3. The control rail 28 is designed in such a way that it acts on the cam extension 20 of the operating lever 18 and, along a circular movement path of the workpiece holders 6 between the second actuating means 23 and the first actuating means 22, forces the operating lever 18 into an operating position in which the clamping devices 17 are at least almost fully open. In the present case, the clamping device 17 at the unloading position 24 is opened by means of the second actuating means 23 by actuating the operating lever 18, as a result of which it is possible to remove or push out the hollow body 7 from the workpiece holder 6. The workpiece holder 6 arriving at the unloading position 25 in the course of the rotational step movements with the open clamping device 17 is initially kept in the illustrated open position by the first actuating means 22. A hollow body 7 is not pushed into the workpiece holder 6 until just before a further rotational step movement is triggered on the workpiece turntable 3. The first actuating means 22 then releases the operating lever 18 so that the latter, due to the biasing by the spring device 21, can return to its preferred position in which the clamping device 17 is closed and the hollow body 7 is fixed in the workpiece holder 6.

At the first machining position 29, which is arranged offset with respect to the loading position 25 by one angle step of the rotational step movement, by way of example an at least partial unlocking and then a relocking of the hollow body 7 in the workpiece holder 6 takes place. To this end, an actuating module 31 is arranged adjacent to the workpiece turntable 3 and is connected to the machine frame 2 in a stationary manner. The actuating module 31, which is shown in greater detail in FIGS. 3 to 5, comprises by way of example three further actuating means 32, 33, 34 which are each designed to trigger at least proportionally linear actuating movements on the operating levers 18 of the respective workpiece holders 6 temporarily located opposite said actuating means. Each of the actuating means 32, 33, 34 has a rotatably mounted cam disc 35 which is rotatably mounted on the actuating module 31 and can be set in a rotational movement by drive means which will be described in more detail below.

Figure 3:
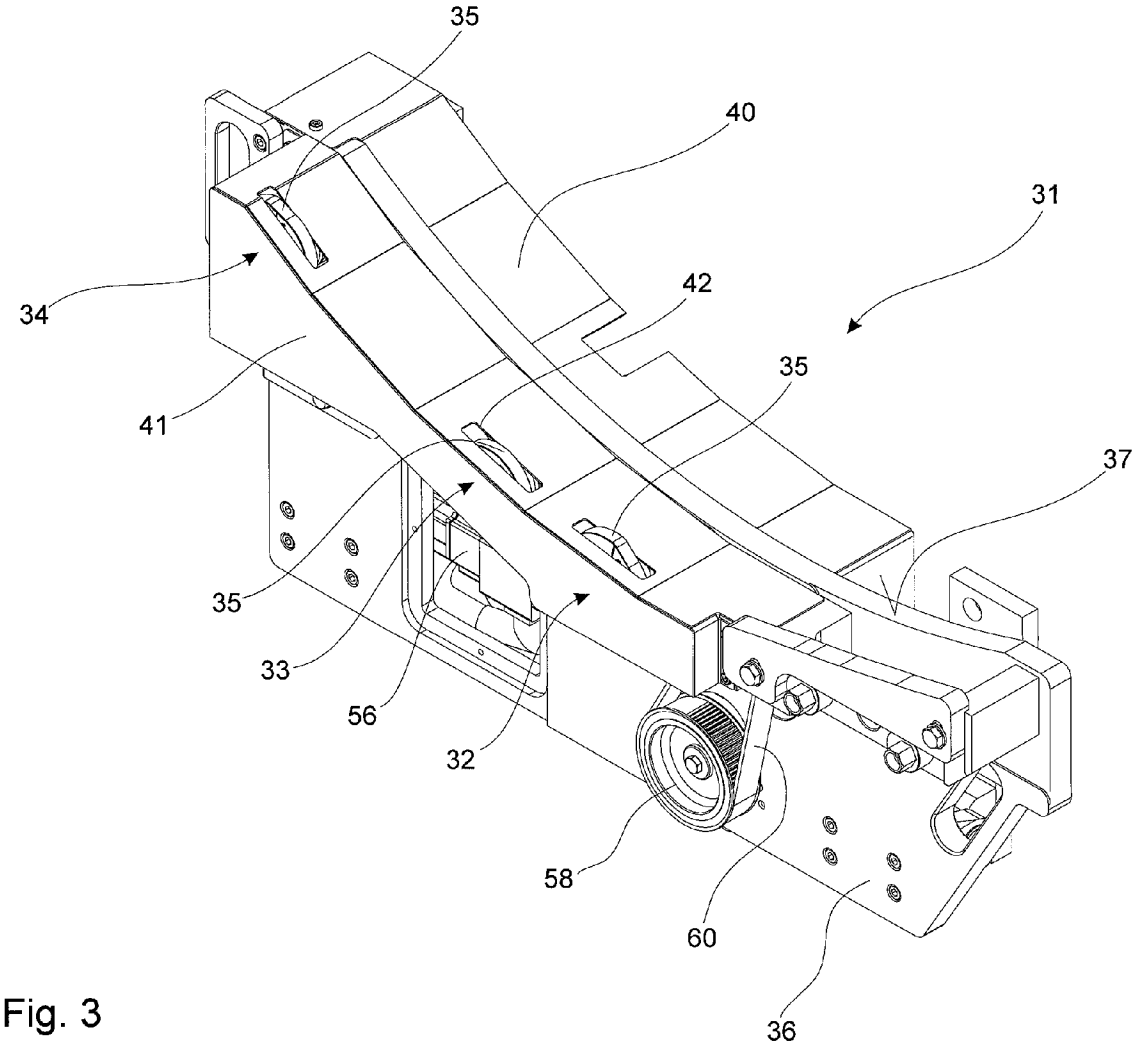
FIG. 3 shows a perspective view of a ready-to-install actuating module, in which a plurality of actuating devices are accommodated.
Figure 4:
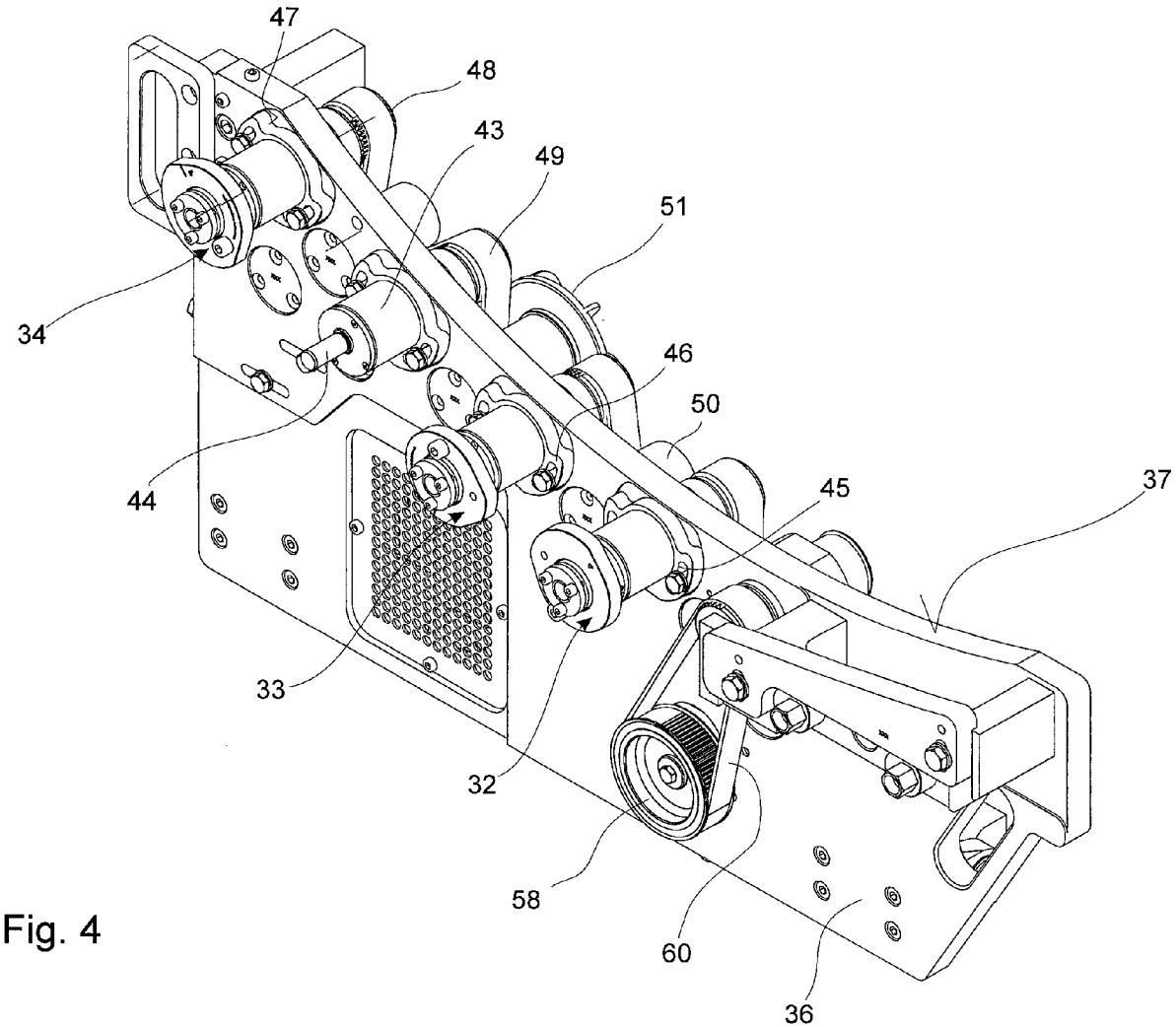
FIG. 4 shows a perspective front view of the actuating module shown in FIG. 3, in a partially assembled state.
Figure 5:
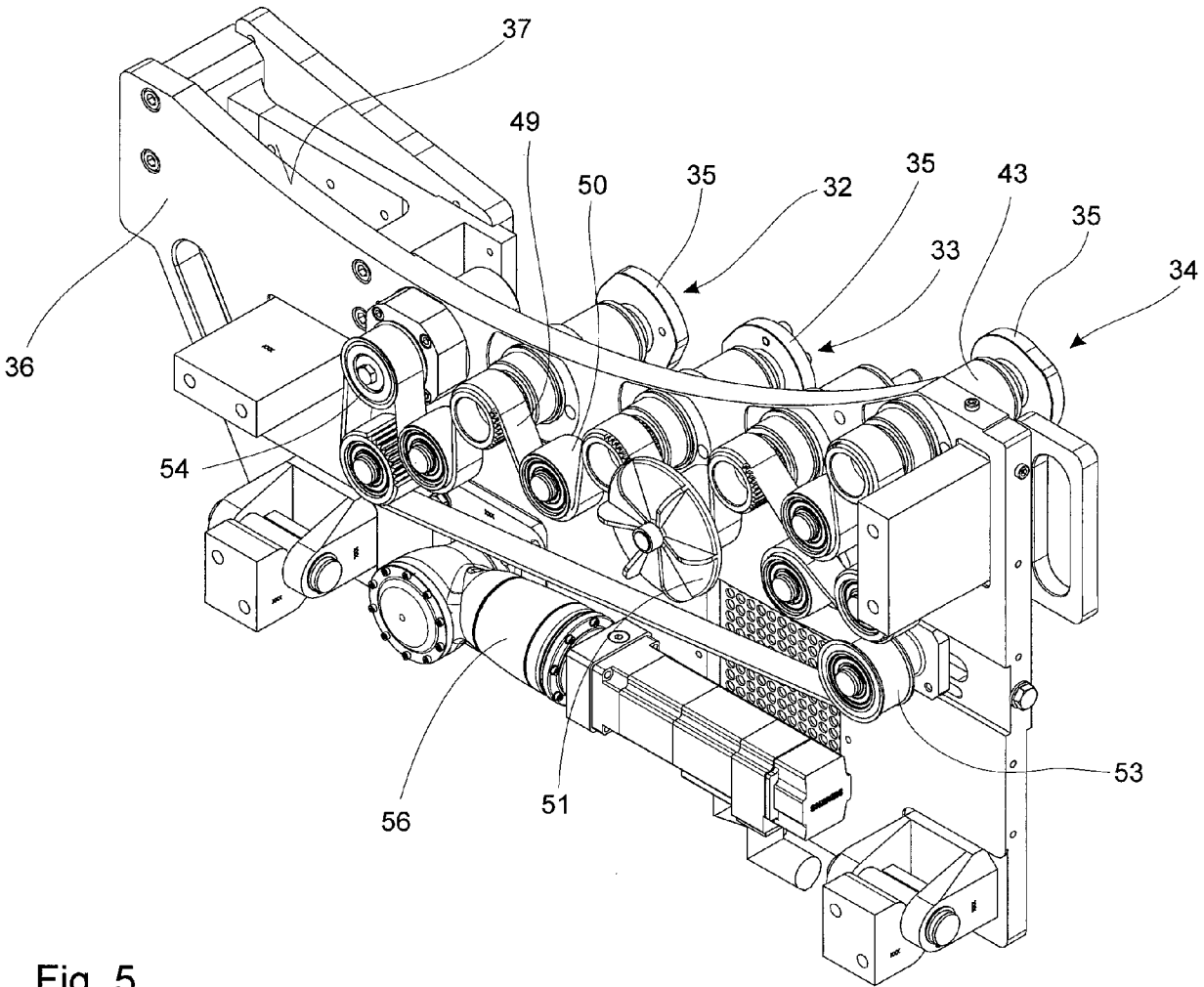
FIG. 5 shows a perspective rear view of the actuating module shown in FIG. 3, in a partially assembled state.

As can be seen from FIGS. 3 to 5, the actuating module 31 comprises by way of example one base plate 36 which has a curved end face 37 adapted in terms of its radius of curvature to the curvature of the workpiece turntable 3. The end face 37 is intended to be arranged opposite the circumferential outer surface of the workpiece turntable 3, as can be seen schematically for example from FIG. 2. The end face 37 is adjoined on both sides by cover plates 40 which, along with a trim plate 41, serve to cover the mechanical components of the actuating module 31, said components being described in greater detail below. Provided in some areas of the cover plates 40 are slot-shaped cutouts 42, through which the cam discs 35 of the actuating means 32, 33, 34 protrude in such a way that they come into touching contact with the cam extensions 20 of the operating levers 18.

In the diagram of FIG. 4, the cover plates 40 and the trim plate 41 are removed so that the individual actuating means 32, 33, 34 are more clearly visible. The actuating means 32, 33, 34 each comprise a sleeve-shaped bearing flange 43, in which a shaft 44 is rotatably mounted by means of bearing means which are not shown in any detail, in particular rolling bearings. Each bearing flange 43 has at its end two attachment lugs 46 which are in the shape of an annular portion and are each provided with a cutout 45 in the shape of a circular arc portion, said attachment lugs being received in depressions 47 shaped as a circular arc portion in the base plate 36. By virtue of the cutouts 45 in the shape of a circular arc portion, the bearing flanges 43 can be rotated relative to the base plate 36 for adjustment purposes. The shaft 44 rotatably mounted in the bearing flange 43 protrudes beyond the bearing flange 43 and can be provided with the cam disc 35 attached in a rotationally fixed manner.

A toothed wheel 48 (shown in greater detail in FIG. 5) is in each case arranged in a rotationally fixed manner on an end region of the shaft 44 which is located opposite the cam disc 35 and which passes through the base plate 36. The toothed wheels 48 of the actuating means 32, 33, 34 are kinematically positively coupled to one another by means of an endlessly revolving traction means 49, which in the present case is designed by way of example as a toothed belt. Deflection rollers 50 are in each case arranged between the actuating means 32, 33, 34, said deflection rollers being provided to ensure that the traction means 49 wraps securely around the toothed wheels 48. One of the deflection rollers 50 is provided with a fan wheel 51 which is intended to generate an air flow over the traction means 49 for cooling purposes. A further deflection roller is designed as a tensioning roller 53 which is adjustable in a linear manner relative to the base plate 3 so as to be able to adjust the tension of the traction means 49 and in particular to facilitate a replacement of the traction means 49.

A further toothed wheel is designed as a toothed drive wheel 54 which is coupled by way of example to a transmission device 55. The transmission device 55 is in turn kinematically connected to a drive motor 56 which may in particular be designed as a fluid motor or electric motor, preferably as a servo motor, and which triggers a rotational movement in the transmission device 55. In the transmission device 55, which is designed by way of example as an angle transmission, the rotational movement is preferably stepped down, that is to say the rotational speed is reduced and the torque is increased and is forwarded from there to the toothed drive wheel 54 which drives the traction means 49 and brings about a synchronous rotation of the toothed wheels 48 and of the cam discs 35 coupled thereto. In the present case, a further traction means 60 is provided between a driven roller 57 of the transmission device 55 and a toothed coupling wheel 58 which is connected via a shaft 59 in a rotationally fixed manner to the toothed drive wheel 54.

By means of the cam discs 35 assigned to the actuating means 32, 33, 34, the workpiece holders 6 positioned at the first, second and fourth machining positions 29, 30, 61 can be acted upon by a linear actuating movement which acts in each case in an at least almost radial direction inwards on the associated cam extensions 20 of the operating levers 18 and brings about an actuation of the respective clamping device 17 from the closed preferred position or locked position into the unlocked position or open position.

Figure 6:
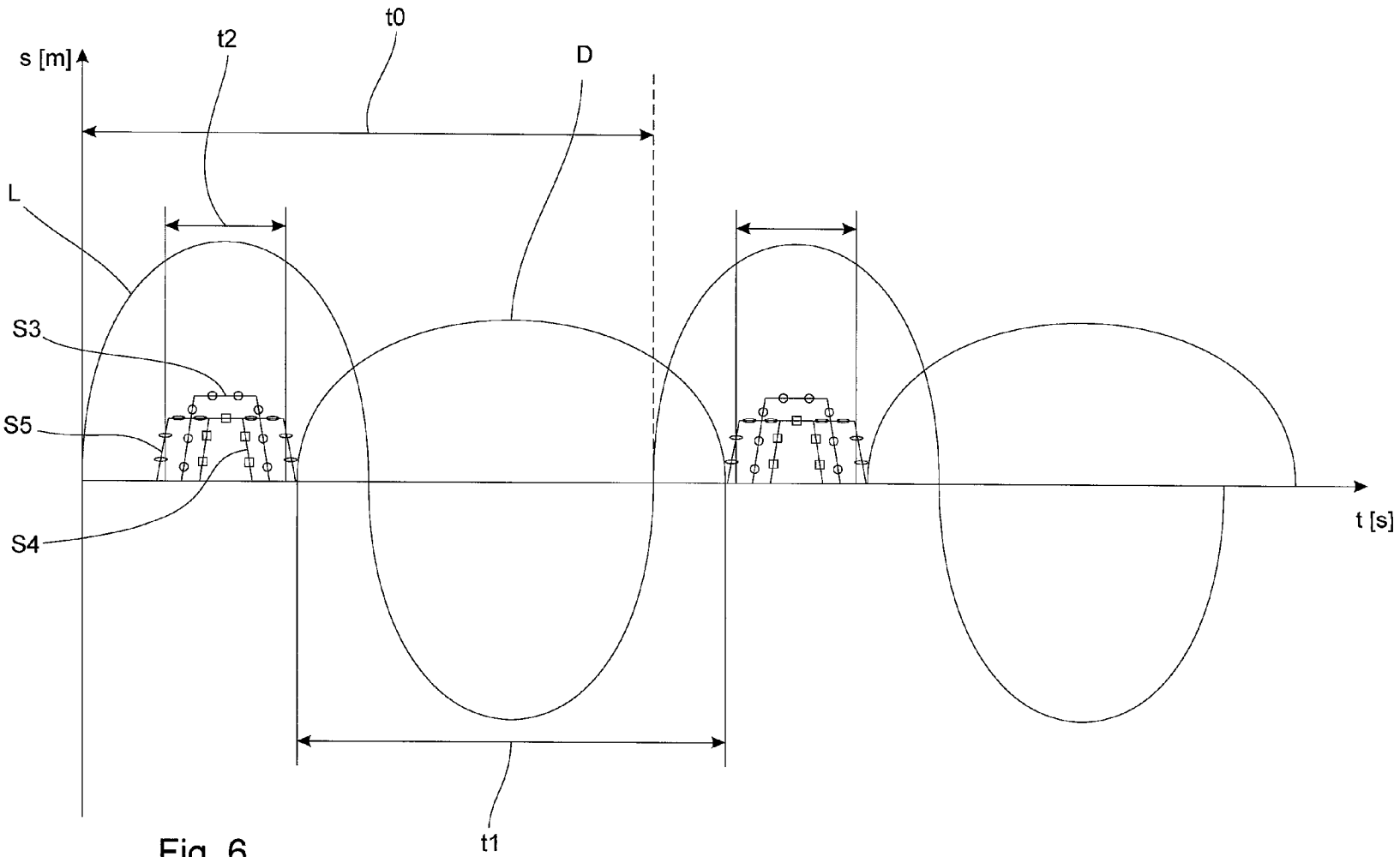
FIG. 6 shows a temporal graph for the implementation of the machining method.

The graph shown in FIG. 6 is an example of the procedures taking place during the machining of the hollow bodies 7. The time t [s] is plotted on the abscissa of the graph, and the distance s [m] is plotted on the ordinate. The cyclic linear movement can be shown for example as a sinusoidal linear oscillation of the tool holder 4 and is denoted by the letter L. The cyclic linear movement repeats within a time interval denoted t0.

The rotational step movement, which is denoted by the letter D, can be shown for example as a series of sinusoidal curve halves spaced temporally apart from one another. The rotational step movement takes place in each case within a time interval denoted t1. Preferably, the cyclic linear movement and the rotational step movement are tailored to one another in such a way that the workpiece turntable 3 is at a standstill while the machining tools 10 are in engagement with the hollow bodies 7. The engagement time is denoted t2.

The linear actuating movements S3, S4 and S5 of the third, fourth and fifth actuating means 32, 33 and 34 are synchronised with one another with regard to the positive coupling brought about by the traction means in terms of the respective angular speed, but have different phase patterns due to the different geometric shape of the cam discs 35. The actuating movements S3 and S4 take place within the engagement time denoted t2, whereas the actuating movement S5 already starts before the engagement time t2 and does not end until after the engagement time t2 has expired, wherein in the present case there is no overlapping of the actuating movements S3, S4 and S5 with the rotational step movement. As a result, it is ensured that the hollow bodies 7 are reliably fixed in the workpiece holders 6 during the rotational step movement.

The phase pattern S3 for the linear actuating movement of the third actuating means 32 is selected such that the clamping device 17 of the workpiece holder 6 arranged opposite is brought out of the fully locked preferred position into a fully unlocked position and then back into the fully locked preferred position. By way of example, after a base forming process in which contact between the base of the hollow body and a bearing surface in the workpiece holder 6 is lost, the hollow body 7 can thus be pushed into the workpiece holder 6 and can thus once again be brought to bear flat against the workpiece holder 6.

The phase pattern S4 for the linear actuating movement of the fourth actuating means 33 is selected such that the clamping device 17 of the workpiece holder 6 arranged opposite is brought out of the fully locked preferred position for a brief period of time which preferably corresponds to less than 15 percent of the cycle duration of the cyclic linear movement, into a partially unlocked position and then back into the fully locked preferred position. By way of example, after a machining process with machining forces acting asymmetrically on the hollow body 7, the hollow body 7 can thus be correctly realigned with respect to the workpiece holder 6.

The phase pattern S5 for the linear actuating movement of the fifth actuating means 34 is selected such that the clamping device 17 of the workpiece holder 6 arranged opposite is brought out of the fully locked preferred position for a longer period of time which corresponds to almost 25 percent of the cycle duration of the cyclic linear movement, into a partially unlocked position and then back into the fully locked preferred position. By way of example, after a detection process in which the rotational position of the hollow body 7 about its longitudinal axis has been determined, the hollow body 7 can thus be rotated into a correct rotational position by means of a rotary tool attached to the tool holder 4.

The invention claimed is:

1. A forming device for cup-shaped hollow bodies comprising a machine frame, a drive device, a workpiece turntable for holding workpiece holders which are designed to fix hollow bodies and a tool holder for holding machining tools wherein the workpiece turntable and the tool holder are located opposite one another and can rotate relative to one another about an axis of rotation and can move linearly relative to one another along the axis of rotation, wherein the drive device is designed to provide a rotational step movement and a cyclic linear movement between the workpiece turntable and the tool holder in order to allow a forming of the hollow bodies by means of the machining tools in a plurality of successive machining steps, and wherein the workpiece turntable is assigned at a locking position a first actuating means for triggering a locking movement on the respective workpiece holder and at an unlocking position a second actuating means for triggering an unlocking movement on the respective workpiece holder, wherein a third actuating means is arranged along a curved machining path for the hollow bodies between the locking position and the unlocking position, said third actuating means being designed to trigger a combined unlocking and locking movement on the respectively associated workpiece holder in order to at least partially unlock, and then lock once again the hollow body held in the respective workpiece holder during one cycle of the cyclic linear movement of the tool holder.

2. A forming device according to claim 1, wherein the third actuating means is designed to provide a linear movement.

3. A forming device according to claim 1, wherein the third actuating means is designed to provide a cyclically repeating actuating movement on the respectively associated workpiece holder said actuating movement being synchronized with the cyclic linear movement/or with the rotational step movement.

4. A forming device according to claim 1, wherein the actuating means are designed to actuate a clamping device which is arranged in the workpiece holder.

5. A forming device according claim 1, wherein the clamping device is assigned biasing means which are designed to set the clamping device into a preferred position intended for immobilising the hollow body and wherein the biasing means are configured in such a way that they can be overridden by the actuating means in order to allow the actuation of an operating position other than the preferred position.

6. A forming device according to claim 1, wherein the third actuating means comprises a cam disc which is mounted such as to be able to rotate about an axis of rotation and which is designed to provide the actuating movement for the respectively associated workpiece holder.

7. A forming device according to claim 1, wherein the actuating means is assigned a drive means which is designed to provide the actuating movement.

8. A forming device according to claim 7, wherein a plurality of actuating means are kinematically connected to one another by the drive means for synchronised, in-phase, actuating movements.

9. A forming device according to claim 8, wherein a plurality of actuating means are coupled to one another by an endlessly revolving traction means which can be driven by the drive means.

10. A forming device according to claim 1, wherein the hollow body is moved between being partially unlocked and then locked again.

11. A forming device according to claim 2, wherein the linear movement is oriented transversely to the axis of rotation.

12. A forming device according to claim 4, wherein the clamping device is actuated by a pivotably mounted operating lever assigned to the workpiece holder.

13. A method for operating a forming device which comprises a machine frame, a drive device, a workpiece turntable to which a plurality of workpiece holders can be attached for holding hollow bodies and which is assigned at a locking position a first actuating means for triggering a locking movement on the respective workpiece holder and at an unlocking position a second actuating means for triggering an unlocking movement on the respective workpiece holder and a tool holder for holding machining tools wherein the workpiece turntable and the tool holder are located opposite one another and can rotate relative to one another about an axis of rotation and can move linearly relative to one another along the axis of rotation, and wherein the drive device is designed to provide a rotational step movement and a cyclic linear movement between the workpiece turntable and the tool holder in order to allow a forming of the hollow bodies by means of the machining tools in a plurality of successive machining steps, wherein the method comprises the steps of:

feeding a hollow body into a workpiece holder;

actuating the first actuating means in order to trigger a locking movement on the respective workpiece holder at a locking position;

carrying out a machining process and/or a detection process on the hollow body;

actuating a third actuating means in order to trigger a combined unlocking and locking movement on the workpiece holder and thereby to at least partially unlock, and then lock once again the hollow body held in the respective workpiece holder;

carrying out a machining process and/or a detection process on the hollow body; and actuating the second actuating means in order to trigger an unlocking movement on the respective workpiece holder at an unlocking position.

14. A method according to claim 13, wherein the third actuating means carries out an at least partial unlocking and subsequent locking of the workpiece holder during one cycle of the cyclic linear movement.

15. A method according to claim 14, wherein the at least partial unlocking and subsequent locking of the workpiece holder is used for a rotation of the hollow body about a longitudinal axis of the hollow body.

16. A method according to claim 14, wherein the at least partial unlocking and subsequent locking of the workpiece holder takes place in order to be able to carry out a linear movement of the hollow body along a longitudinal axis of the hollow body.

17. A method according to claim 13, wherein an at least partial unlocking and subsequent locking of the workpiece holder is carried out during the cyclic linear movement at a plurality of working positions of the rotational step movement between the locking position and the unlocking position.

18. A method according to claim 13, wherein the hollow body is moved between being partially unlocked and then locked once again.

19. A method according to claim 15, wherein the longitudinal axis is oriented parallel to the cyclic linear movement, and/or for a pressing of the hollow body against a bearing surface in the workpiece holder.

20. A method according to claim 16, wherein the longitudinal axis is oriented parallel to the cyclic linear movement.

* * * * *